US009810498B1

(12) United States Patent
Winiecki

(10) Patent No.: US 9,810,498 B1
(45) Date of Patent: Nov. 7, 2017

(54) METHOD OF PREVENTING ACCIDENTAL SHOOTINGS WITH A FIREARM SAFETY BEACON

(71) Applicant: Kenneth Carl Steffen Winiecki, Cupertino, CA (US)

(72) Inventor: Kenneth Carl Steffen Winiecki, Cupertino, CA (US)

( * ) Notice: Subject to any disclaimer, the term of this patent is extended or adjusted under 35 U.S.C. 154(b) by 0 days.

(21) Appl. No.: 15/649,417

(22) Filed: Jul. 13, 2017

Related U.S. Application Data

(63) Continuation of application No. 15/355,012, filed on Nov. 17, 2016, now Pat. No. 9,739,556, and a continuation-in-part of application No. PCT/IB2016/052611, filed on May 6, 2016, and a continuation-in-part of application No. PCT/US2015/038644, filed on Jun. 30, 2015.

(60) Provisional application No. 62/262,716, filed on Dec. 3, 2015, provisional application No. 62/204,208, filed on Aug. 12, 2015, provisional application No. 62/256,543, filed on Nov. 17, 2015.

(51) Int. Cl.
*F41A 17/06* (2006.01)
*F41A 17/08* (2006.01)
*F41A 17/46* (2006.01)

(52) U.S. Cl.
CPC ..... *F41A 17/063* (2013.01); *F41A 17/08* (2013.01); *F41A 17/46* (2013.01)

(58) Field of Classification Search
CPC ..... F41A 17/46; F41A 17/063
USPC ..... 42/1.01
See application file for complete search history.

(56) References Cited

U.S. PATENT DOCUMENTS 4,361,911 A * 11/1982 Buser ..... G01S 17/74 342/45
4,763,361 A * 8/1988 Honeycutt ..... G01S 7/499 342/45
5,302,938 A * 4/1994 Martineau ..... A01M 31/004 116/67 R
5,307,053 A * 4/1994 Wills ..... F41A 17/06 340/539.1
5,355,241 A * 10/1994 Kelley ..... G01S 7/48 342/45
5,375,008 A * 12/1994 Guerreri ..... G01S 17/74 342/45
5,422,645 A * 6/1995 Nettleton ..... G01S 17/74 342/45
8,125,371 B1 * 2/2012 Daniel ..... F41A 17/08 342/175

(Continued)

*Primary Examiner* — Joshua E Freeman

(57) ABSTRACT

A method of preventing accidental shooting requires a safety beacon and a firearm that has a computing device and a wireless receiver. The method begins by continuously transmitting a warning signal with the safety beacon and by continuously monitoring for the warning signal with the wireless receiver. The method then processes the warning signal into an endangerment assessment with the computing unit, if the warning signal is captured by the wireless receiver. The endangerment assessment is used to determine whether or not it is safe to shoot the firearm based on the location of the safety beacon. Finally, the method executing a physical response with the firearm, if the endangerment assessment identifies a potentially unsafe situation between the safety beacon and the firearm. The physical response can be a tactile, auditory, or visual notification to the user of the potentially unsafe situation.

15 Claims, 13 Drawing Sheets

(56) References Cited

U.S. PATENT DOCUMENTS 8,936,193 B2 * 1/2015 McHale ..... F41G 3/12 235/417
2005/0115386 A1 * 6/2005 LaFata ..... F41A 17/08 89/1.11
2008/0165047 A1 * 7/2008 Fisher ..... F41A 17/06 342/45
2009/0045996 A1 * 2/2009 Ivtsenkov ..... A61B 5/6814 342/45
2009/0146793 A1 * 6/2009 Fullerton ..... G06K 19/0723 340/10.4
2011/0025491 A1 * 2/2011 Cazanas ..... F41A 19/01 340/539.1
2011/0063102 A1 * 3/2011 Ivtsenkov ..... F41A 17/063 340/505
2011/0119979 A1 * 5/2011 Gussalli Beretta ..... F41A 19/01 42/1.02
2011/0156914 A1 * 6/2011 Sheharri ..... F41A 17/063 340/573.1
2011/0271573 A1 * 11/2011 Vielbig ..... F41A 21/28 42/1.01
2012/0073178 A1 * 3/2012 Ivtsenkov ..... F41A 17/063 42/70.06
2013/0015977 A1 * 1/2013 Scott ..... G01S 17/74 340/600
2013/0180147 A1 * 7/2013 Lupher ..... F41A 19/58 42/69.01
2014/0182179 A1 * 7/2014 McHale ..... F41A 17/48 42/70.06
2014/0215881 A1 * 8/2014 Milde, Jr. ..... F41A 35/00 42/70.06
2014/0230296 A1 * 8/2014 Kuparinen ..... F41A 17/063 42/1.01
2015/0108215 A1 * 4/2015 Ehrlich ..... G01S 17/88 235/404
2015/0194033 A1 * 7/2015 Esposito ..... G08B 21/02 340/686.6
2015/0241153 A1 * 8/2015 Mardirossian ..... F41A 17/08 42/70.11
2015/0253109 A1 * 9/2015 Wichner ..... F41A 17/12 434/19
2016/0021329 A1 * 1/2016 Sakiewicz ..... H04N 5/772 386/227
2016/0223278 A1 * 8/2016 Schechter ..... F41A 17/063
2017/0059274 A1 * 3/2017 Crist ..... F41A 17/06

* cited by examiner

METHOD OF PREVENTING ACCIDENTAL SHOOTINGS WITH A FIREARM SAFETY BEACON

The current application is a continuation application of a U.S non-provisional application Ser. No. 15/355,012 filed on Nov. 17, 2016. The U.S non-provisional application 15/355,012 claims a priority to the U.S. Provisional Patent application Ser. No. 62/262,716 filed on Dec. 3, 2015.

FIELD OF THE INVENTION

The present invention relates generally to firearm accessories. More specifically, the present invention is a method of using a firearm safety beacon in order to indicate to the shooter if there is a person in the line of fire.

BACKGROUND OF THE INVENTION

The present invention is a method of implementing a firearm safety beacon that alerts the shooter if someone is in their line of fire. It is estimated that approximately 1,000 people in the United States and Canada are accidentally shot by hunters every year, and about 100 of those accidents are fatal. Accidental shots are caused by the inability to see past the shooters target, thus hitting someone behind the target or by mistaking a human for an animal. Therefore, the present invention aims to reduce injuries and fatalities related to hunting accidents and the like. The present invention will alert the user through the firearm safety beacon that a person is in their line of fire, preventing accidental shots. In this regard, the shooter does not need to be able to physically see if someone is in their line of fire as the present invention will automatically detect an individual and alert the shooter. The present invention is not limited to hunting and can be applied to various scenarios and settings such as military and law enforcement exercises to reduce and prevent friendly fire.

The present invention will also have a proximity function to prohibit firearms from being discharged when within the vicinity of a beacon. In this regard, a plurality of beacons can be strategically placed in public locations such as schools, hospitals and shopping malls to prevent firearms from being discharged in such locations. Additionally, an individual may utilize a beacon to prevent accidental discharge when cleaning their firearm. Therefore, the objective of the present invention is to prevent and to reduce firearm related injuries and fatalities.

DETAILED DESCRIPTION OF THE INVENTION

All illustrations of the drawings are for the purpose of describing selected versions of the present invention and are not intended to limit the scope of the present invention.

The present invention is a method of preventing accidental shootings with a firearm safety beacon. The present invention is used to alert someone shooting a firearm that a friendly person is in their line of fire. Thus, the physical system used to implement the method of the present invention includes a safety beacon and a firearm, which is shown in in FIGS. 1A, 1B, 2A, and 2B. The safety beacon is worn by a user in order to communicate their presence to the firearm and to consequently communicate their presence to the shooter of the firearm (Step A). Alternatively, the safety beacon could be a situated device within a safe zone. The firearm must also be provided with a wireless receiver and a computing unit, which allow the firearm to receive and to process signals from the firearm (Step B).

Figure 3:
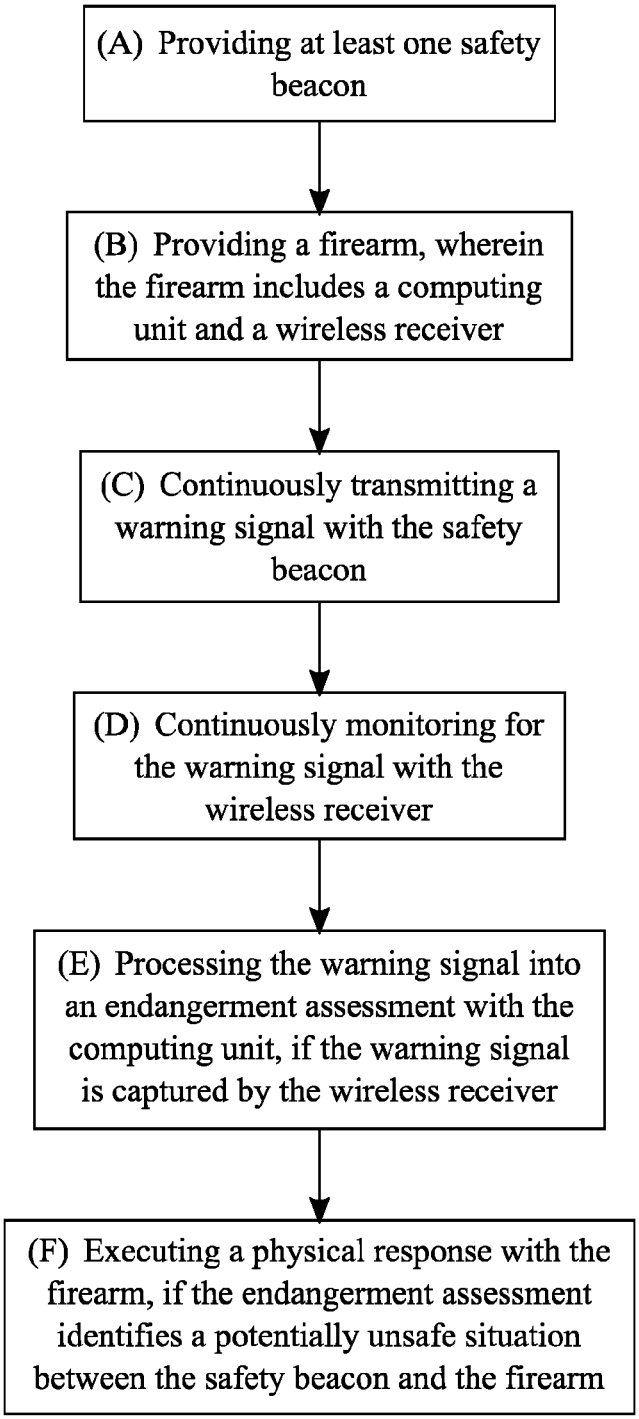
FIG. 3 is a flow chart illustrating the overall process for the present invention.

As can be seen in FIG. 3, the overall process for present invention includes steps that are taken by the safety beacon and the firearm in order to prevent accidental shootings. The overall process begins by continuously transmitting a warning signal with the safety beacon (Step C), which allows the firearm to continuously monitor for the warning signal with the wireless receiver (Step D). The warning signal is preferably a low-frequency electromagnetic wave, such as a radio wave, so that the warning signal is able to travel from the safety beacon to the firearm even with some kind of obstruction in between the safety beacon and the firearm. For example, some shrubs and/or tree branches may act as an obstruction between the safety beacon and the firearm during a hunting session. The warning signal may also be embedded with certain kinds of information in order to indicate whether the warning signal is proximity-based warning or a direction-based warning. The overall process continues by processing the warning signal into an endangerment assessment with the computing unit, if the warning signal is captured by the wireless receiver of the firearm (Step E). The endangerment assessment is used to analyze the circumstances surrounding the warning signal captured by the wireless receiver and provides a determination as to whether or not firing the firearm would create a potentially unsafe situation for the user with the safety beacon. The overall process concludes by executing a physical response with the firearm, if the endangerment assessment identifies a potentially unsafe situation between the safety beacon and the firearm (Step F). The physical response is used to alert the shooter that is holding the firearm to the potential unsafe situation. The potential unsafe situation is defined as a scenario where the user of the safety beacon would come into harm's way if the shooter fires the firearm.

Figure 1A:
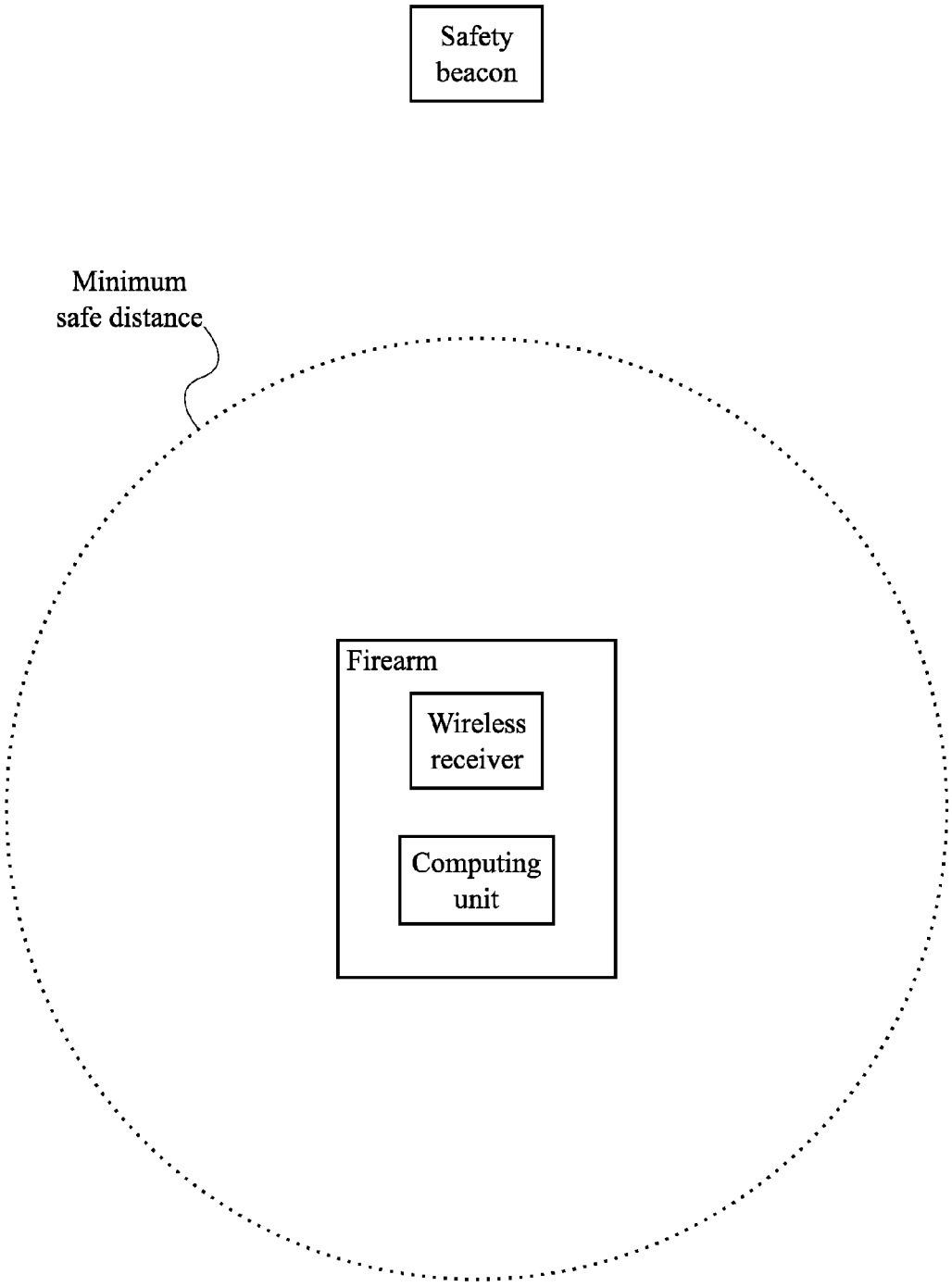
FIG. 1A is a schematic view for a system of the present invention that is able to generate a proximity-based warning.
Figure 1B:
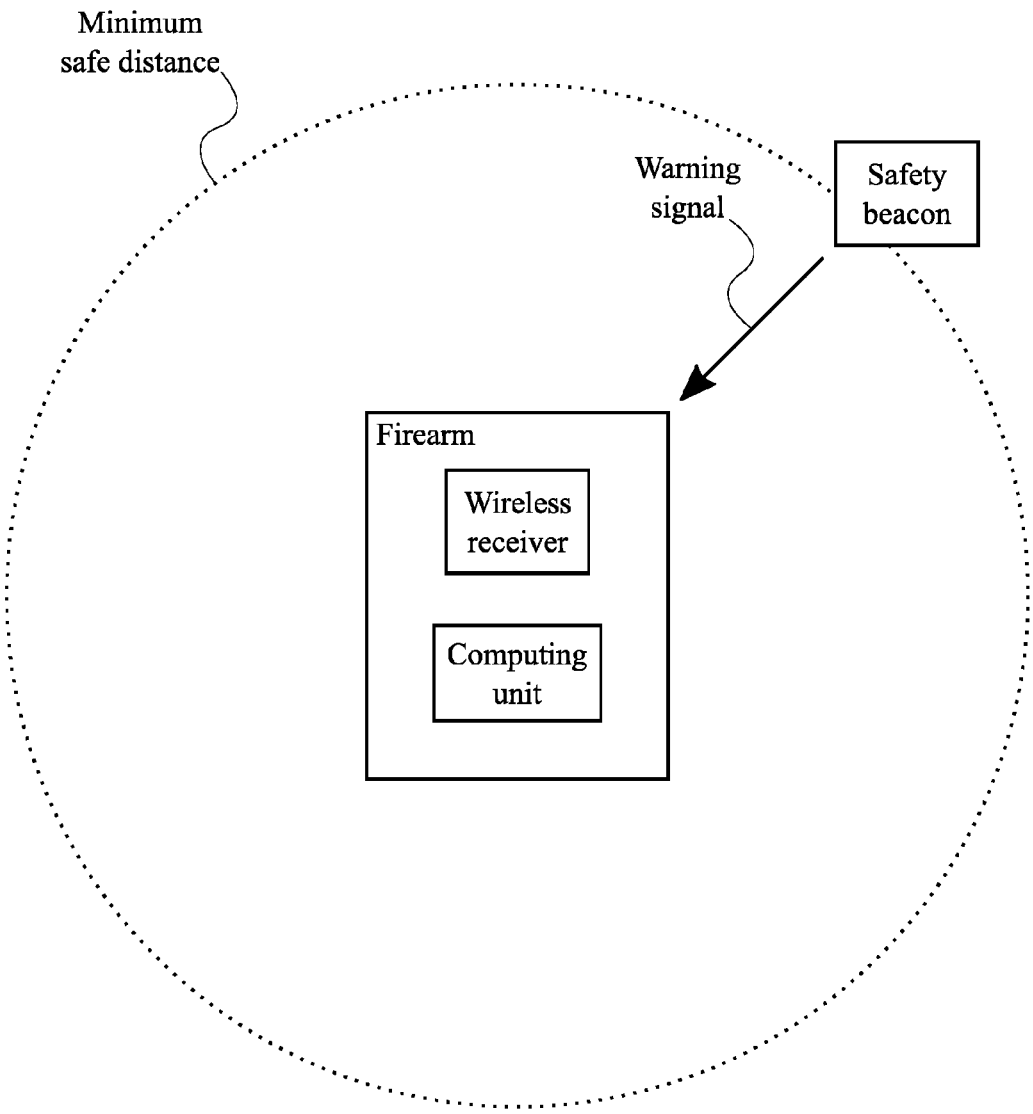
FIG. 1B is a schematic view for the system of the present invention that is generating the proximity-based warning.
Figure 4:
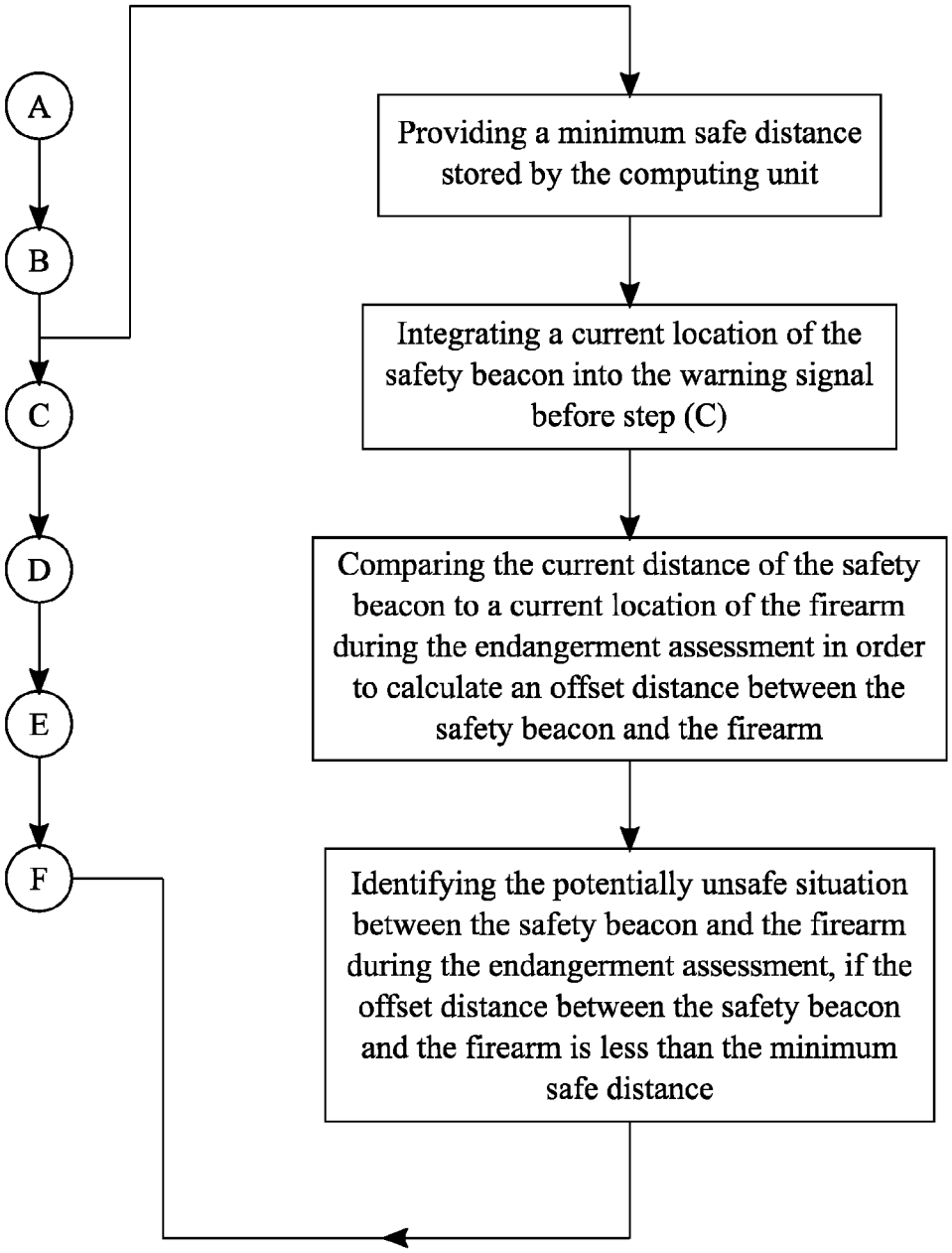
FIG. 4 is a flow chart illustrating the process of generating a proximity-based warning with the present invention.

In one embodiment, the present invention is configured to initiate the physical response according to a proximity-based warning, which is shown in FIGS. 1A and 1B. In order to implement the proximity-based warning, the present invention needs to be provided with a minimum safe distance, which is stored on the computing device of the firearm. The minimum safe distance is the shortest allowable distance between the safety beacon and the firearm that is deemed "safe" by the present invention. As can be seen in FIG. 4, this embodiment varies the overall process of the present invention by integrating the current location of the safety beacon into the warning signal before step C so that the current location of the safety beacon can be used as one of the circumstances that is analyzed by the endangerment assessment. During the endangerment assessment, the computing unit of the firearm compares the current distance of the safety beacon to a current location of the firearm in order to calculate an offset distance between the safety beacon and the firearm. This allows the computing unit of the firearm to identify the potential unsafe situation between the safety beacon and the firearm, if the offset distance between the safety beacon and the firearm is less than the minimum safe distance. In other words, this embodiment of present invention allows the physical response by the firearm to be activated if the safety beacon is located too close to the firearm. For example, if a user has their safety beacon and is cleaning their firearm, then the physical response would be activated by the firearm because the user cleaning their firearm is in a potentially unsafe situation.

Figure 5:
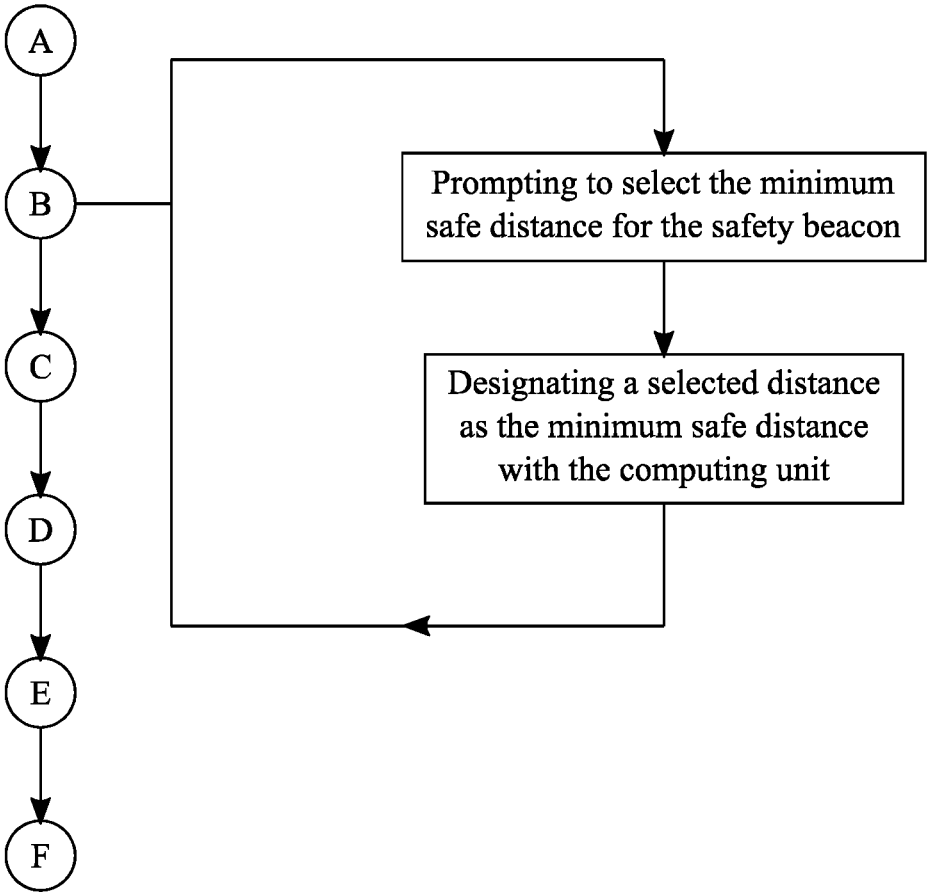
FIG. 5 is a flow chart illustrating the process of setting the minimum safe distance for the proximity-based warning.

For the proximity-based warning, the present invention can also allow the user to adjust the effective range of the safety beacon in order to prevent accidental shootings within a larger area, which is shown in FIG. 5. Thus, the user can be prompted to select the minimum safe distance for the safety beacon so that the selected distance from the user can be designated as the minimum safe distance with the computing unit. For example, the user could place the safety beacon in the middle of their house and set to the minimum safe distance to be the general radius of their house so that the firearm could not be fired within their house.

Figure 2A:
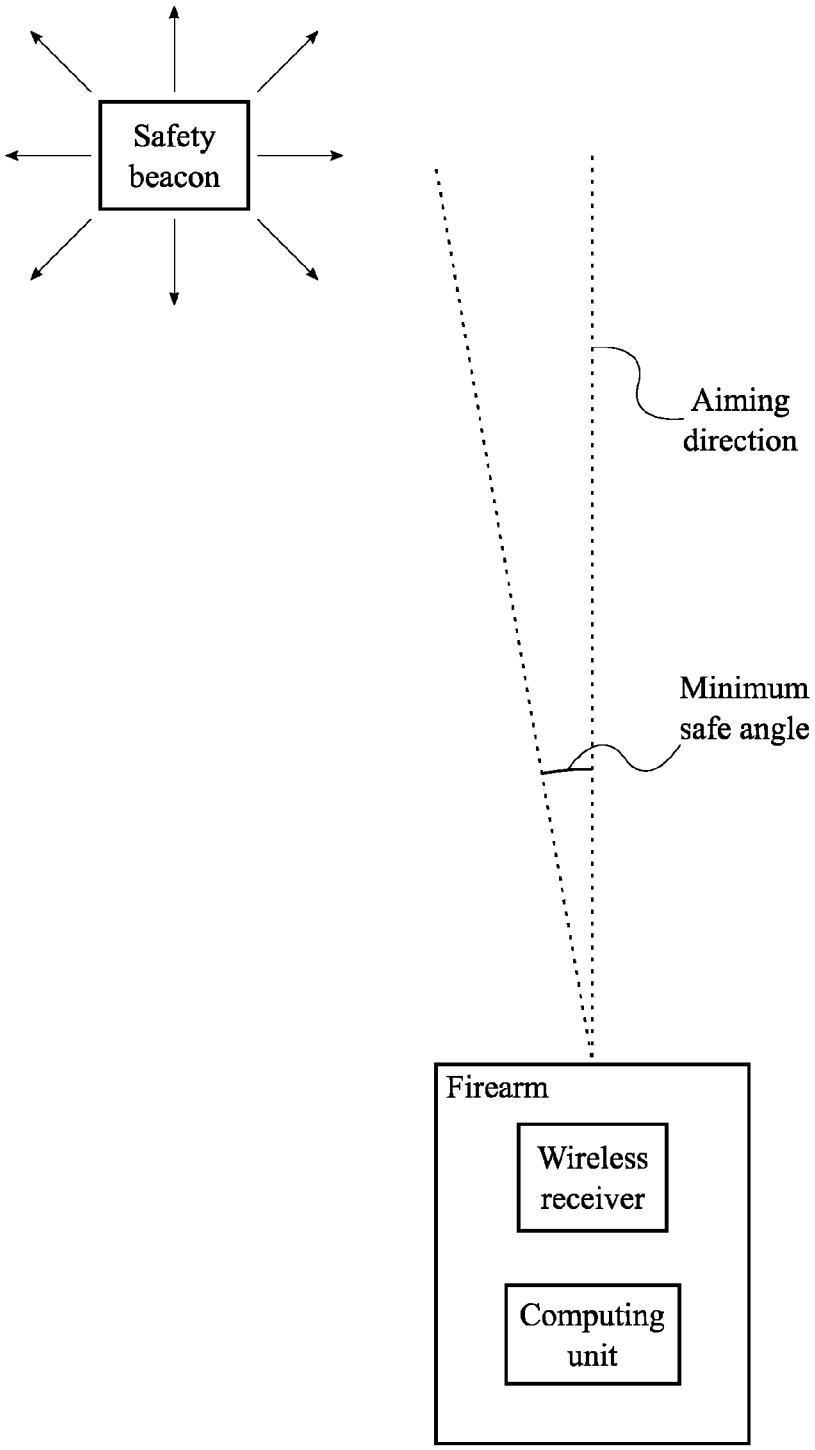
FIG. 2A is a schematic view for a system of the present invention that is able to generate a direction-based warning.
Figure 2B:
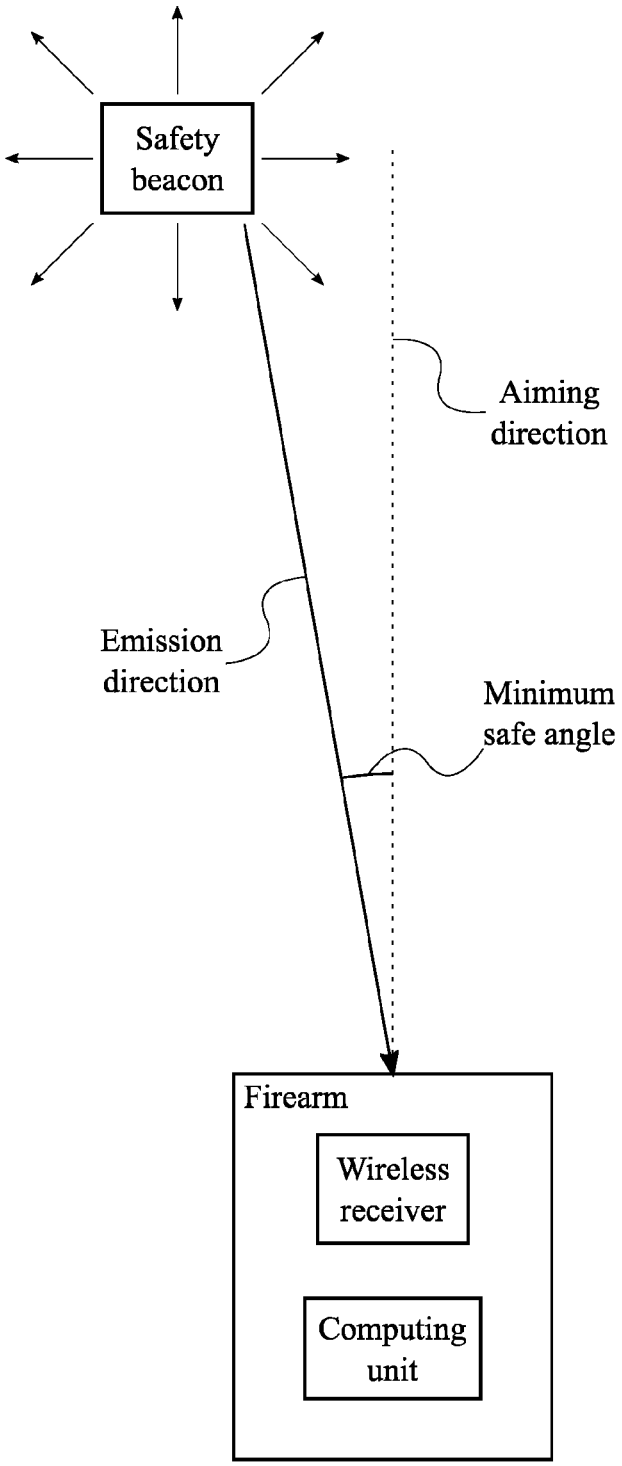
FIG. 2B is a schematic view for the system of the present invention that is generating the direction-based warning.
Figure 6:
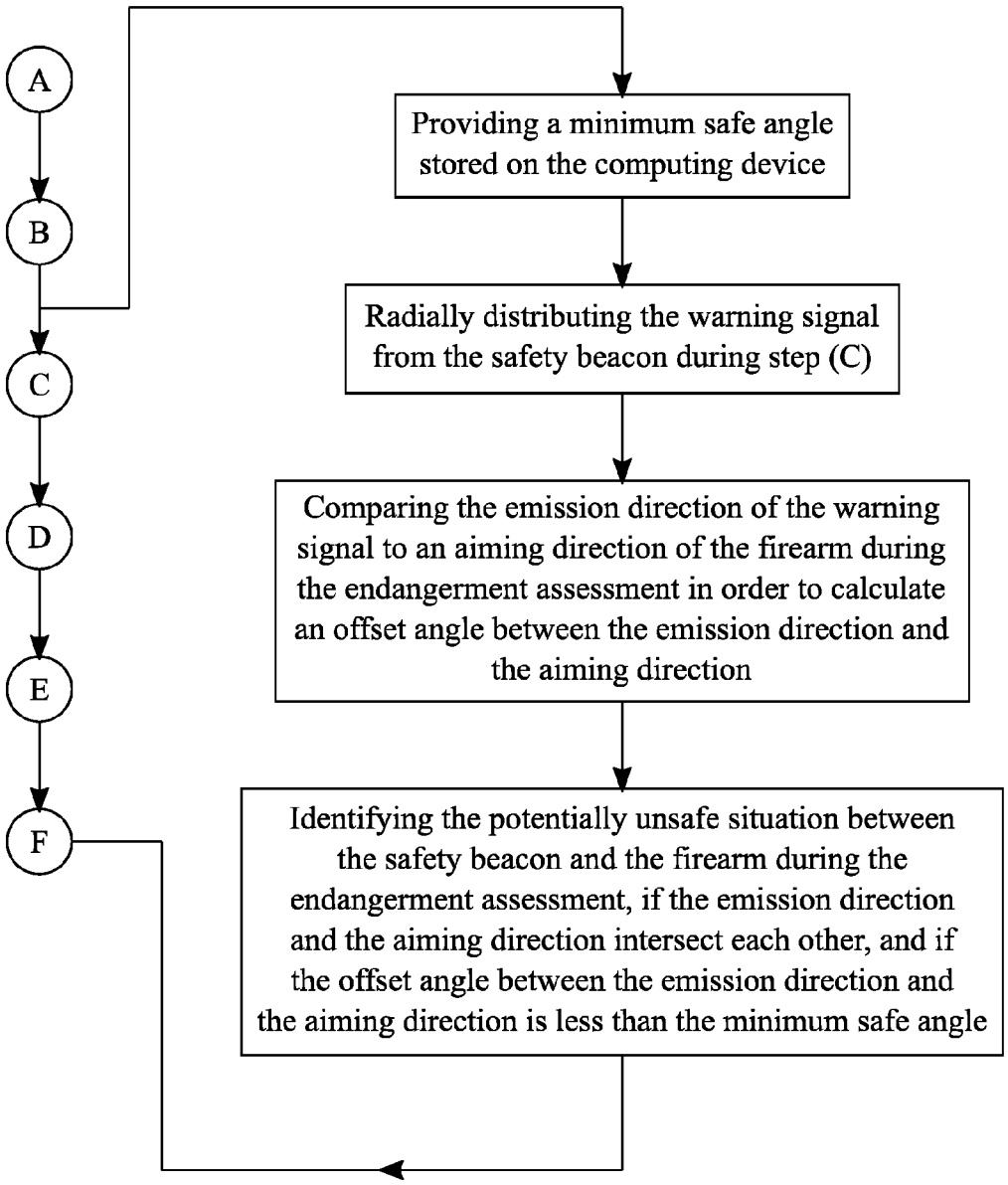
FIG. 6 is a flow chart illustrating the process of generating a direction-based warning with the present invention.

In another embodiment, the present invention is configured to initiate the physical response based on a direction-based warning, which is shown in FIGS. 2A and 2B. In order to implement the direction-based warning, the present invention needs to be provided with a minimum safe angle, which is stored on the computing unit of the firearm. The minimum safe angle is the smallest allowable angle between a line drawn from the safety beacon to the firearm and a trajectory line for bullets being fired from the firearm that is deemed "safe" by the present invention. As can be seen in FIG. 6, this embodiment also varies the overall process of the present invention by radially distributing the warning signal from the safety beacon during step C. This allows the firearm to sense an emission direction of the warning signal with the wireless receiver because the safety beacon is understood to be the origin point for the radially-emitted warning signal. During the endangerment assessment, the computing unit of the firearm compares the emission direction of the warning signal to an aiming direction of the firearm in order to calculate an offset angle between the emission direction and the aiming direction. The aiming direction of the firearm is typically coincident with the barrel of the firearm. Next in the endangerment assessment, the computing unit is able to identify the potentially unsafe situation between the safety beacon and the firearm, if the emission direction and the aiming direction intersect each other, and if the offset angle between the emission direction and the aiming direction is less than the minimum unsafe angle. In other words, this embodiment of present invention allows the physical response by the firearm to be activated if the firearm is aimed towards the safety beacon. For example, if a shooter is aiming the firearm towards an object and if the safety beacon is coincident somewhere along the light of sight between the firearm and the object, then the physical response would be activated by the firearm because the user with the safety beacon is in a potentially unsafe situation.

Figure 7:
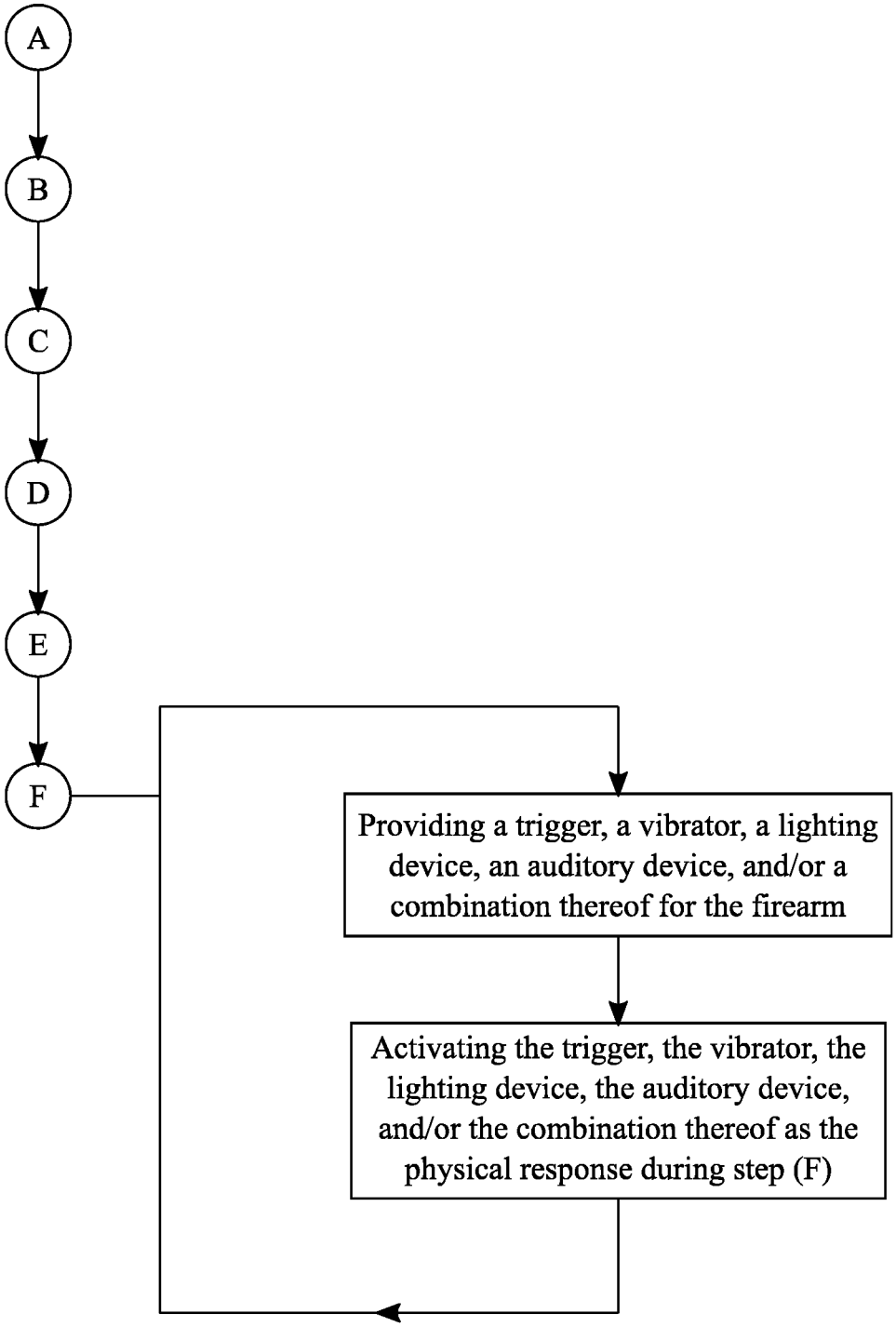
FIG. 7 is a flow chart illustrating the process of activating the physical response on the firearm.

As can be seen in FIG. 7, the present invention allows for different kinds of physical responses to be executed by the firearm during step F. One kind of physical response is to mechanically lock the trigger of the firearm, which would the safest approach to prevent accidental shootings by the firearm. Another kind of physical response is to activate a vibrator that is integrated into the firearm, which would not prevent the shooter from firing the firearm but would alert the shooter of the safety beacon. Yet another kind of physical response is to activate a lighting device that is externally mounted onto the firearm, which again would not prevent the shooter from firing the firearm but would alert the shooter of the safety beacon. Yet another kind of physical response is to activate an auditory device that is integrated into the firearm, which also would not prevent the shooter from firing the firearm but would alert the shooter of the safety beacon.

Figure 8:
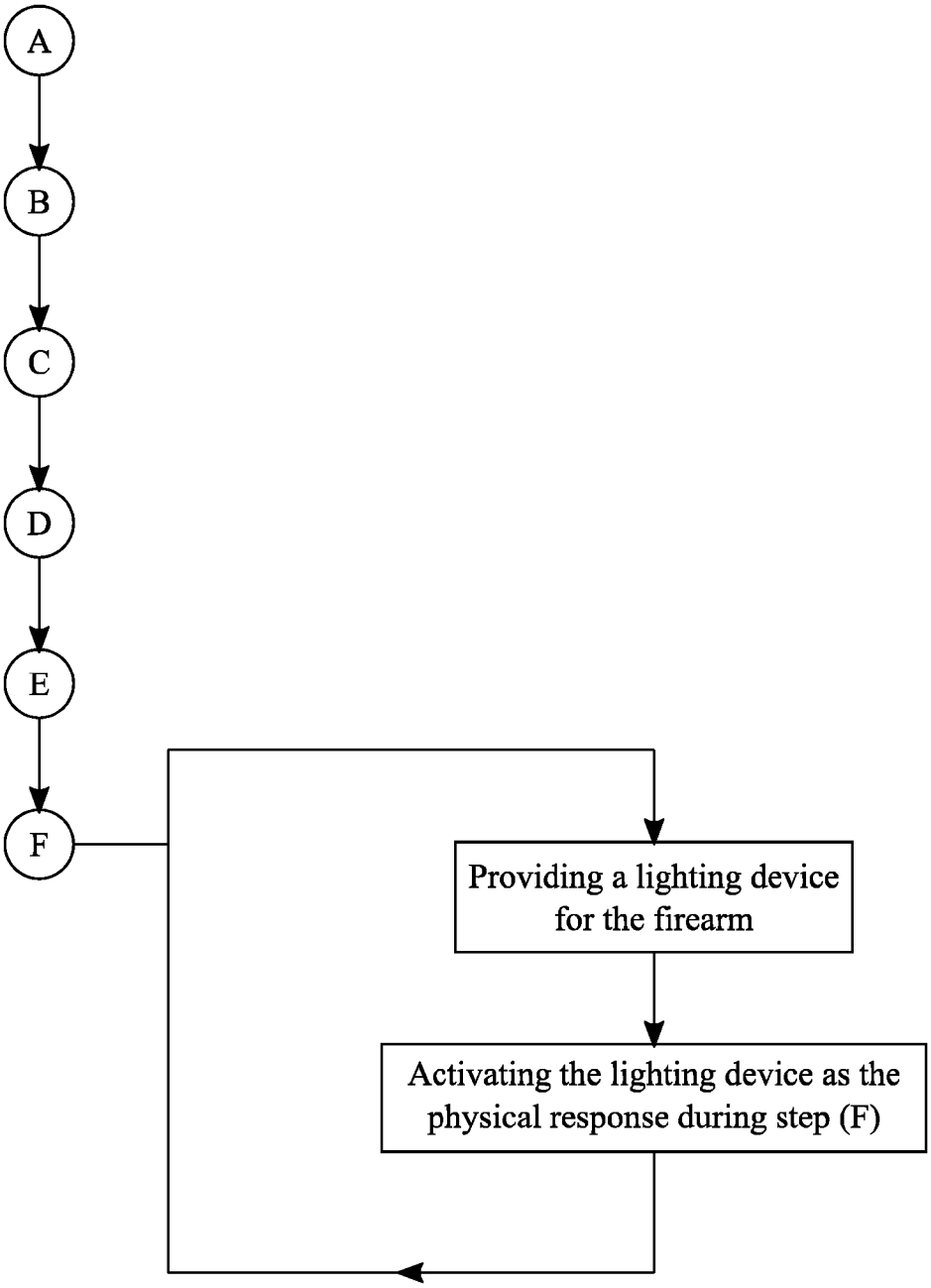

As can be seen in FIG. 8, the present invention is designed to prevent accidental shootings with the firearm but does not intend to hinder the primary functionality of the firearm. For example, if a burglar enters a home and has a safety beacon, then the home owner with a firearm would be alerted not to shoot the burglar or would not be able to shoot the burglar. However, the present invention is designed to accommodate this situation by prompting to initiate an unsafe mode for the firearm with the computing unit. This allows the shooter to disable the physical response during step F, if the unsafe mode is initiated for the firearm. The unsafe mode is more useful for the present invention when the physical response locks the trigger of the firearm, which renders the firearm completely useless.

Figure 11:
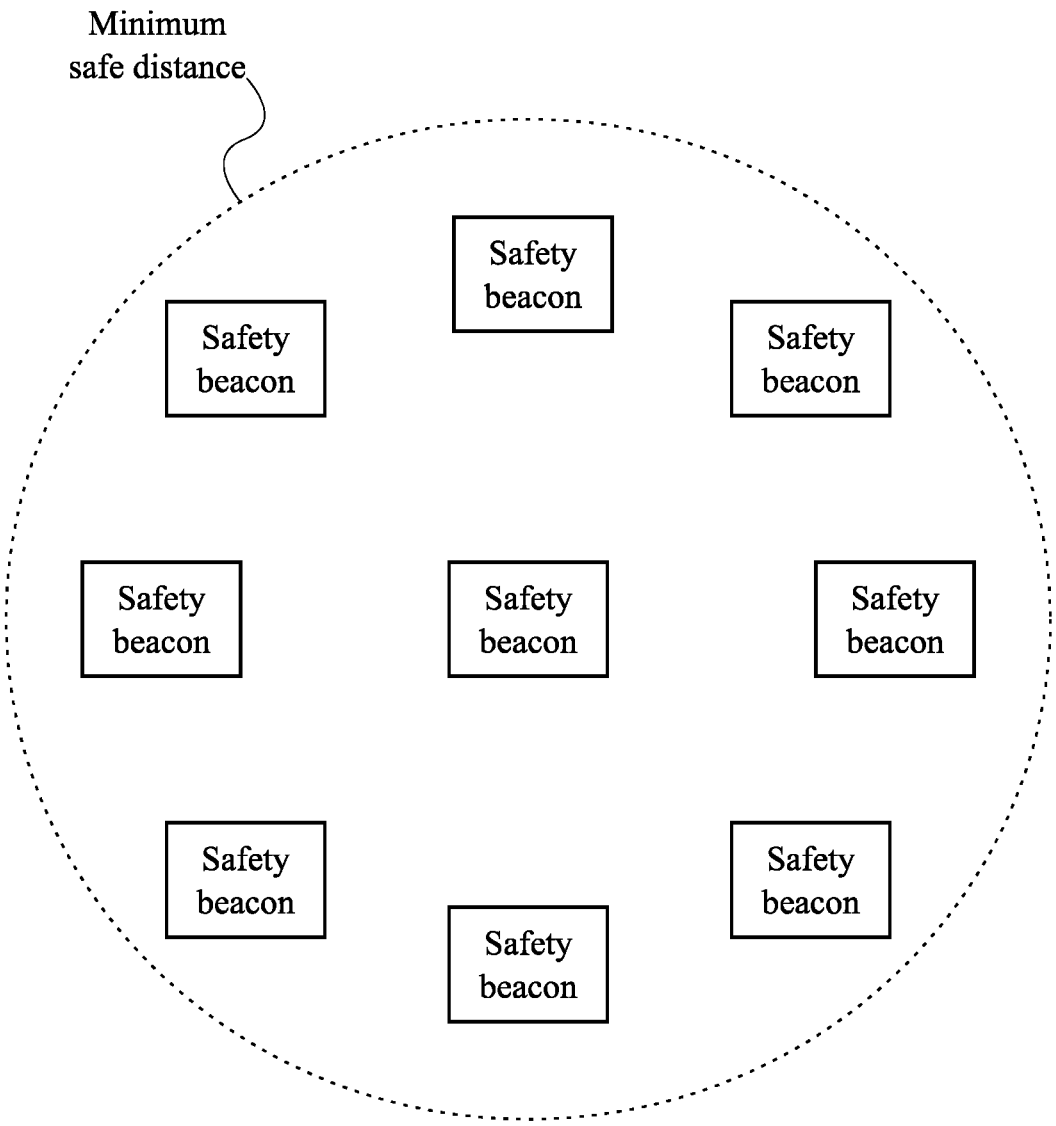
FIG. 11 is a schematic view for a system using multiple safety beacons in order to generate a designated safe zone with the present invention.

As can be seen in FIG. 11, the present invention can also be configured to prevent accidental shootings in much larger public areas such as schools and hospitals. In order to create this designated safe zone, the present invention needs to be provided with a plurality of safety beacons. The plurality of safety beacons is distributed throughout the designated safe zone so that the physical response is activated for the firearm if the firearm comes too close to the designated safe zone and/or if the firearm is oriented towards the designated safe zone.

Figure 9:
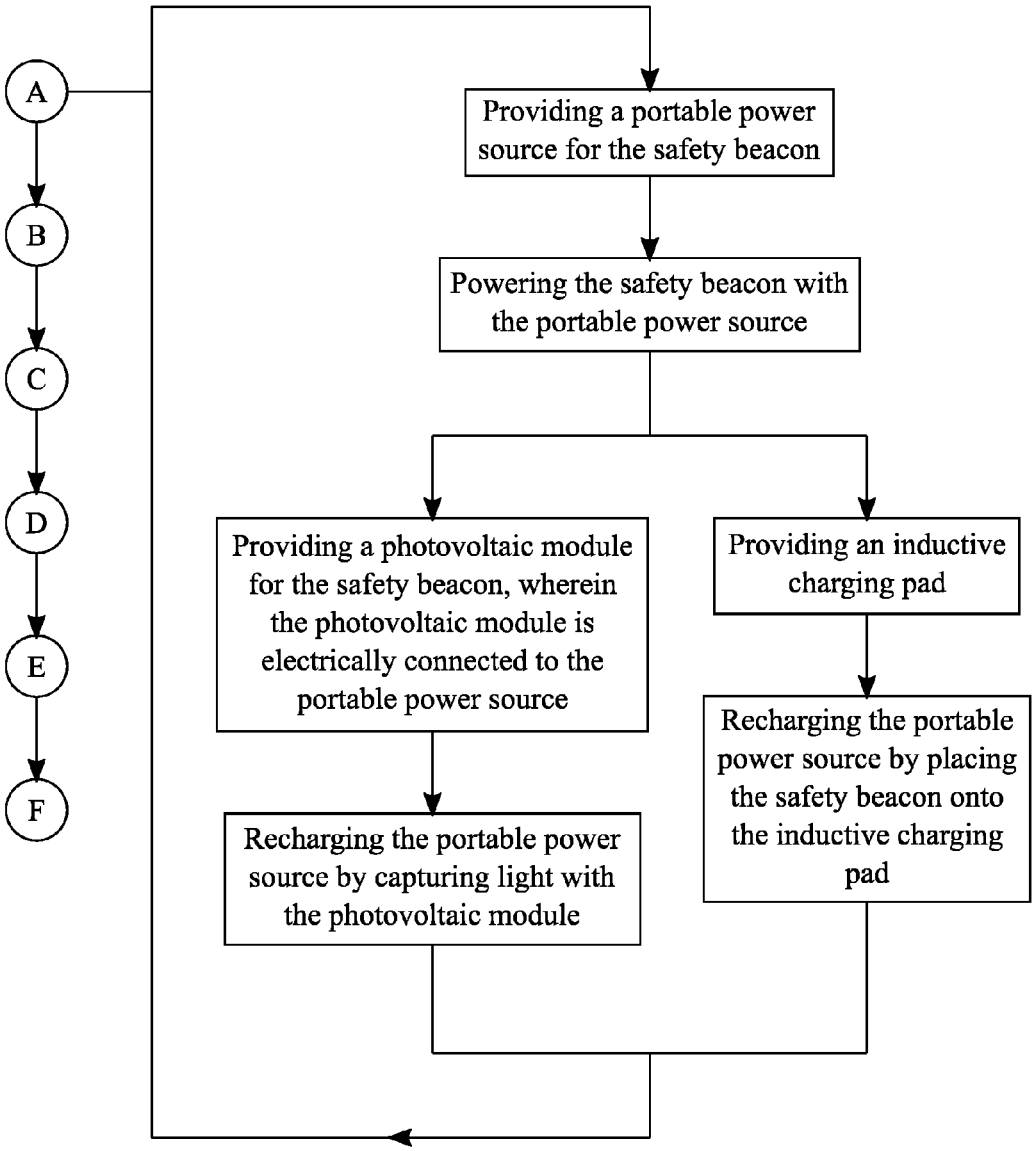
FIG. 9 is a flow chart illustrating the process of powering the safety beacon.
Figure 10:
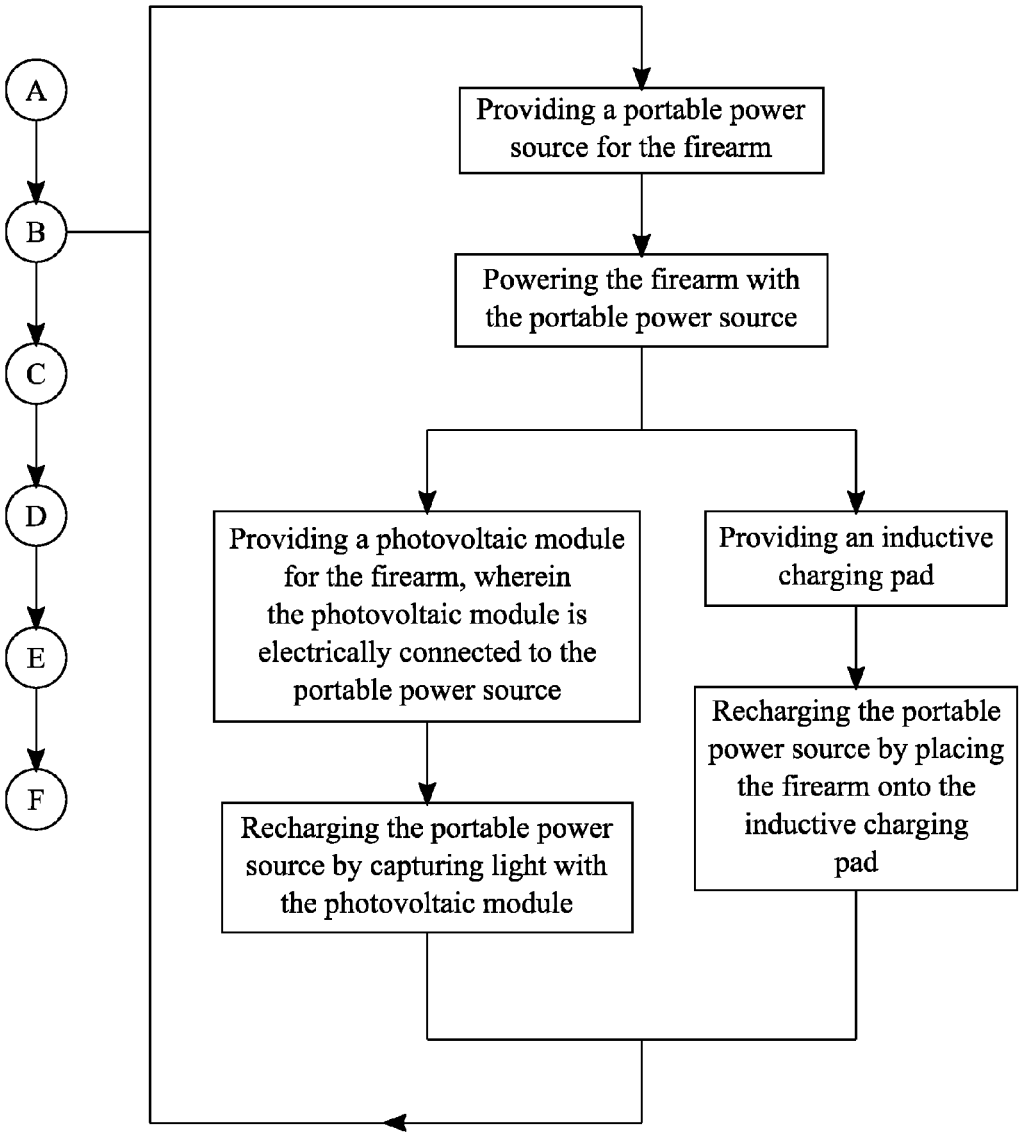
FIG. 10 is a flow chart illustrating the process of powering the firearm.

In addition, the firearm and the safety beacon are each provided with a portable power source because the firearm and the safety beacon are relatively mobile in the context of the present invention. As can be seen in FIG. 9, the portable power source for the safety beacon allows the safety beacon to emit the warning signal from remote locations from the firearm. As can be seen in FIG. 10, the portable power source for the firearm is used to power the computing unit and the componentry used to execute the physical response. In addition, the portable power source for both the safety beacon and the firearm can be recharged through different mechanisms. One such mechanism is a photovoltaic module that is electrically connected to the portable power source and recharges the portable power source by capturing the light surrounding the safety beacon or the firearm. Another such mechanism is an inductive charging pad that recharges the portable power source by simply placing either the safety beacon or the firearm onto the inductive charging pad.

Although the invention has been explained in relation to its preferred embodiment, it is to be understood that many other possible modifications and variations can be made without departing from the spirit and scope of the invention as hereinafter claimed.

What is claimed is:

1. A method of preventing accidental shootings with a firearm safety beacon, the method comprises the steps of:

(A) providing at least one safety beacon;

(B) providing a firearm, wherein the firearm includes a computing unit and a wireless receiver;

(C) continuously transmitting a warning signal with the safety beacon;

(D) continuously monitoring for the warning signal with the wireless receiver;

(E) processing the warning signal into an endangerment assessment with the computing unit, if the warning signal is captured by the wireless receiver;

(F) executing a physical response with the firearm, if the endangerment assessment identifies a potentially unsafe situation between the safety beacon and the firearm;

providing a minimum safe distance stored by the computing unit;

integrating a current location of the safety beacon into the warning signal before step (C);

comparing the current distance of the safety beacon to a current location of the firearm during the endangerment assessment in order to calculate an offset distance between the safety beacon and the firearm; and identifying the potentially unsafe situation between the safety beacon and the firearm during the endangerment assessment, if the offset distance between the safety beacon and the firearm is less than the minimum safe distance.

2. The method of preventing accidental shootings with a firearm safety beacon, the method as claimed in claim 1 comprises the steps of:

prompting to select the minimum safe distance for the safety beacon; and designating a selected distance as the minimum safe distance with the computing unit.

3. The method of preventing accidental shootings with a firearm safety beacon, the method as claimed in claim 1 comprises the steps of:

providing a minimum safe angle stored on the computing device;

radially distributing the warning signal from the safety beacon during step (C);

sensing an emission direction of the warning signal with the wireless receiver;

comparing the emission direction of the warning signal to an aiming direction of the firearm during the endangerment assessment in order to calculate an offset angle between the emission direction and the aiming direction; and identifying the potentially unsafe situation between the safety beacon and the firearm during the endangerment assessment, if the emission direction and the aiming direction intersect each other, and if the offset angle between the emission direction and the aiming direction is less than the minimum safe angle.

4. The method of preventing accidental shootings with a firearm safety beacon, the method as claimed in claim 1 comprises the steps of:

providing a trigger for the firearm; and mechanically locking the trigger as the physical response during step (F).

5. The method of preventing accidental shootings with a firearm safety beacon, the method as claimed in claim 1 comprises the steps of:

providing a vibrator for the firearm; and activating the vibrator as the physical response during step (F).

6. The method of preventing accidental shootings with a firearm safety beacon, the method as claimed in claim 1 comprises the steps of:

providing a lighting device for the firearm; and activating the lighting device as the physical response during step (F).

7. The method of preventing accidental shootings with a firearm safety beacon, the method as claimed in claim 1 comprises the steps of:

providing an auditory device for the firearm; and activating the auditory device as the physical response during step (F).

8. The method of preventing accidental shootings with a firearm safety beacon, the method as claimed in claim 1 comprises the steps of:

prompting to initiate an unsafe mode for the firearm with the computing unit; and disabling the physical response during step (F), if the unsafe mode is initiated for the firearm.

9. The method of preventing accidental shootings with a firearm safety beacon, the method as claimed in claim 1 comprises the steps of:

providing a plurality of safety beacons as the at least one safety beacon; and distributing the plurality of safety beacons throughout a designated safe zone.

10. The method of preventing accidental shootings with a firearm safety beacon, the method as claimed in claim 1 comprises the steps of:

providing a portable power source for the safety beacon; and powering the safety beacon with the portable power source.

11. The method of preventing accidental shootings with a firearm safety beacon, the method as claimed in claim 10 comprises the steps of:

providing a photovoltaic module for the safety beacon, wherein the photovoltaic module is electrically connected to the portable power source; and recharging the portable power source by capturing light with the photovoltaic module.

12. The method of preventing accidental shootings with a firearm safety beacon, the method as claimed in claim 10 comprises the steps of:

providing an inductive charging pad; and recharging the portable power source by placing the safety beacon onto the inductive charging pad.

13. The method of preventing accidental shootings with a firearm safety beacon, the method as claimed in claim 1 comprises the steps of:

providing a portable power source for the firearm; and powering the computing unit and the physical response with the portable power source.

14. The method of preventing accidental shootings with a firearm safety beacon, the method as claimed in claim 13 comprises the steps of:

providing a photovoltaic module for the firearm, wherein the photovoltaic module is electrically connected to the portable power source; and recharging the portable power source by capturing light with the photovoltaic module.

15. The method of preventing accidental shootings with a firearm safety beacon, the method as claimed in claim 13 comprises the steps of:

providing an inductive charging pad; and recharging the portable power source by placing the firearm onto the inductive charging pad.

* * * * *